US006615530B2

(12) United States Patent
Johansson

(10) Patent No.: US 6,615,530 B2
(45) Date of Patent: Sep. 9, 2003

(54) SIGHT

(75) Inventor: Bertil Johansson, Onsala (SE)

(73) Assignee: CBJ Tech AB, Onsala (SE)

( * ) Notice: Subject to any disclaimer, the term of this patent is extended or adjusted under 35 U.S.C. 154(b) by 0 days.

(21) Appl. No.: 09/935,934

(22) Filed: Aug. 23, 2001

(65) Prior Publication Data

US 2002/0062590 A1 May 30, 2002

Related U.S. Application Data

(63) Continuation of application No. PCT/SE00/00353, filed on Feb. 23, 2000.

(51) Int. Cl.[7] ..... F41G 1/00
(52) U.S. Cl. ..... 42/133; 42/140; 42/141
(58) Field of Search ..... 42/111, 133, 134, 42/140, 141

(56) References Cited

U.S. PATENT DOCUMENTS 1,466,913 A * 9/1923 Matthews
1,586,413 A * 5/1926 Doornbos
1,903,326 A * 4/1933 Crawley
2,331,903 A * 10/1943 Garand
3,817,148 A * 6/1974 Schirneker ..... 89/155
4,961,278 A * 10/1990 Johnson et al. ..... 42/101
5,456,035 A * 10/1995 Stiles ..... 42/100
5,533,292 A * 7/1996 Swan ..... 42/100

FOREIGN PATENT DOCUMENTS

| | | |
|---|---|---|
| CH | 234606 | 10/1944 |
| EP | 0134075 | 3/1985 |
| EP | 0195768 | 9/1986 |

* cited by examiner

*Primary Examiner*—Stephen M. Johnson
(74) *Attorney, Agent, or Firm*—Samuels, Gauthier & Stevens, LLP

(57) ABSTRACT

The present invention relates to a sight for firearms, which sight comprises a sight house being applicable onto the upper side of a weapon and in this house a diopter provided unit turnably arranged around a horizontal axis, whereby a cylindrical sight unit is present in the sight house which sight unit comprises segmented extending diopter apertures turnably and horizontally arranged on a threaded bolt which runs between walls of said sight house.

8 Claims, 3 Drawing Sheets

SIGHT

This application is a continuation of PCT/SE00/00353 filed Feb. 23, 2000.

DESCRIPTION

1. Technical Field

The present invention relates to sight for firearms, which sight comprises a sight house being applicable onto the upper side of a weapon and in said house a diopter provided unit turnably arranged around a horizontal axis.

The object of the present invention is to obtain a sight for firearms having on one hand a controllable adjustment of range, so called upsetting, and on the other hand a controllable adjustment of a shot to the side.

2. Background of the Invention

Firearms, such as sub-machine guns and automatic carbines shall contain a sight and a front sight to facilitate not only spreading fire, but also carefully aimed fire, as well.

Further there is a requirement that sight-front sight shall be sturdy to stand very hard trials under field conditions.

The Swedish machine gun m/45 thus comprises a front sight placed in a side protection whereby the front sight is used for sideways adjustment of the aiming, shot adjustment to the side, as the front sight which is radially placed on a rotatably arranged, horizontal washer thus can be moved sideways. The problem is hereby that a turning of one "snap" provides for different sideways hit depending on where on the rotational round the front sight is present. The front sight is also used for shot adjustment in height by turning the front sight whole rounds on its threaded fastening in vertical position. The front sight of a gun m/45 is a number of plates having provided therein a sight slot, which plates can be turned up into a sight holder to adjust the height position for a shot. That is to say that the sight adjusts the elevation of the firing barrel of the weapon to increase the ballistic trajectory at longer distances.

AK4, automatic carbine, which is used inter alia by the Swedish army, has a sight comprising diopters, i.e., sight apertures placed in an obliquely rotatably cylinder whereby at the rotation of the cylinder diopter apertures are placed in the sight line at different heights to obtain an elevation of the barrel of the weapon, so called upsetting. At these weapons a sideways adjustment of the hit point is achieved, sideways shot adjustment, by means of a sideways adjustment of the sight. This latter adjustment is made more or less at random, is complex and requires special tools to carry out.

The Israeli machine gun Uzi has a sight which comprises a unit being turnable around a horizontal shaft and comprising two diopters for the adjustment of the upsetting. The unit just simply encompasses two plates provided with apertures attached to a common shaft whereby at the rotation one way or the other the respective aperture provided plates are arranged into the sight line. The shot adjustment as to height is hereby carried out by adjusting the front sight while adjustment of the shot sideways for adjusting the hit point is carried out by adjusting the sight.

The front sight of a weapon is at field conditions a very exposed part as it is arranged on the front part of the weapon which often will stand in the way at movements in the terrain but also in and out off vehicles. The sight is a less exposed part as it is often protected by the carrier's body.

There is thus a problem at modern firearms to obtain an aiming system for precision aiming which allows for upsetting of the barrel on one hand, and sideways shot adjustment of hit point, i.e., sideways movement of the barrel in relation to the sight line which aiming system is sturdy and simple to adjust.

DESCRIPTION OF THE PRESENT INVENTION

It has now surprisingly turned out possible to be able to solve this problem by means of the present invention which is characterized in that a cylindrical sight unit is placed in the sight house comprising segmentally extending diopter apertures which unit is rotatably, horizontally arranged on a threaded bolt which runs between the walls of said sight house.

Further characteristics are evident from the accompanying claims.

By means of the present invention there is obtained that upsetting and sideways shot adjustment is placed in the sight, i.e., both elevation and side adjustment where the adjustments can be made in a simple and rational way without any need for tools.

Further it is achieved that the sight can be exchanged or replaced when so needed in order to obtain other diopter diameters depending on requirement.

The present invention will be described more in detail in the following with reference to the accompanying drawing, however, without being restricted thereto. The scope of the invention is evident from the accompanying claims. In the drawing FIG. 1 shows a perspective view of a sight house according to the present invention seen at an angle from behind;

Figure 12:
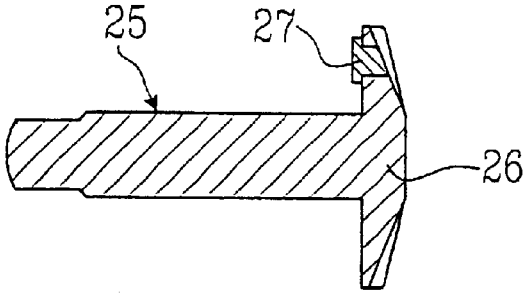
FIG. 12 shows a cross-sectional view of the sight unit of the sight house carrying a through-going bolt.

1 denotes generally a sight house comprising a bottom plate 2, two side walls 3, 4 and a rear wall 5. In one 3 of the side walls a through-going hole 6 is arranged, which hole 6 is arranged to receive one end of a through-going bolt, which will be described more in detail below with reference to FIG. 12. The other wall 4 of the sight house presents a through-going hole 7 arranged to receive said bolt, and is provided with three holes 8 evenly distributed around said hole 7, whereby one is arranged vertically above said hole 7. Said wall 4 is provided with, on its outer side, three further, evenly distributed non-through-going bore-holes 9 the function of which will be evident from below. The rear wall 5 raises up to half of the height of the sight-house 1. Sight house 1 is completely in its front part. The bottom plate 2 has a shape adapted to the weapon onto which it is to be applied. In the bottom plate 2 there is further a recess 28 arranged, which recess has the function of being a stop for a pin 18 of the sight unit, which will described below.

Figure 1:
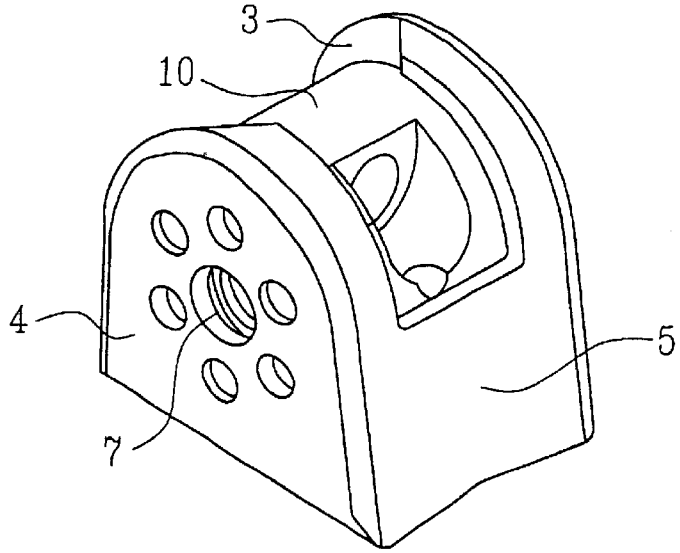
Figure 2:
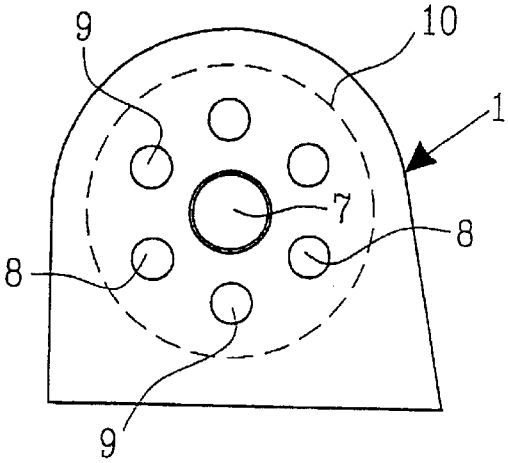
FIG. 2 shows a cross-sectional view of the sight house of FIG. 1.
Figure 3:
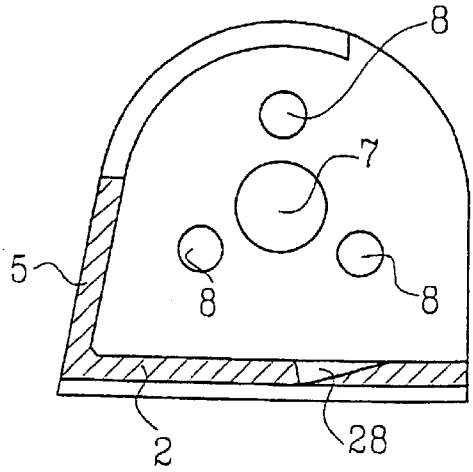
FIG. 3 shows a side view of the sight house of FIG. 1.
Figure 4:
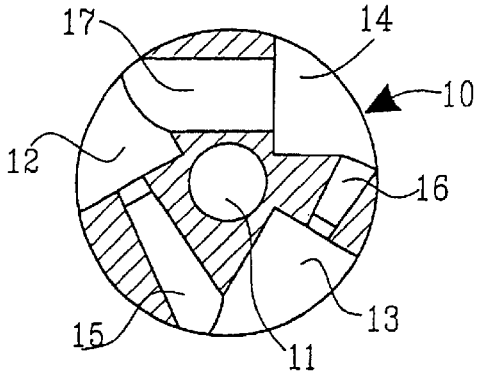
FIG. 4 shows a vertical cross-sectional view through the centre of the sight unit itself, which unit is to placed in the sight house of FIGS. 1–3.
Figure 5:
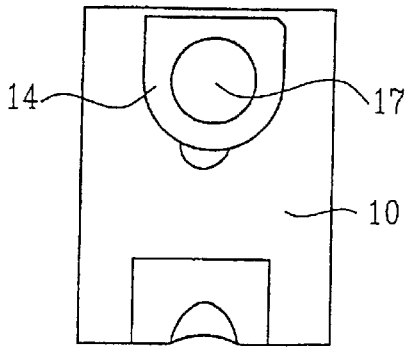
FIGS. 5–7 shows a view of the sight unit according to FIG. 4 whereby different diopters of the unit are being illustrated.
Figure 6:
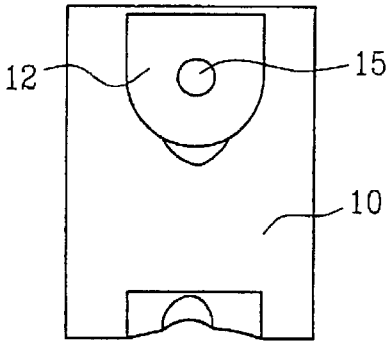
Figure 7:
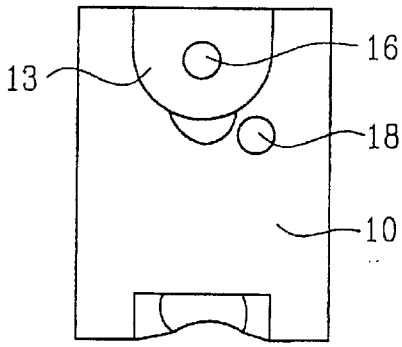
Figure 8:
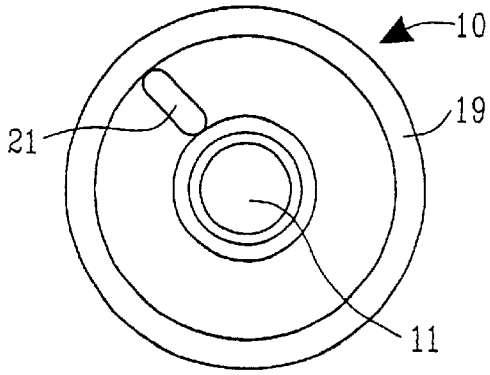
FIG. 8 shows a side view of the sight unit.
Figure 9:
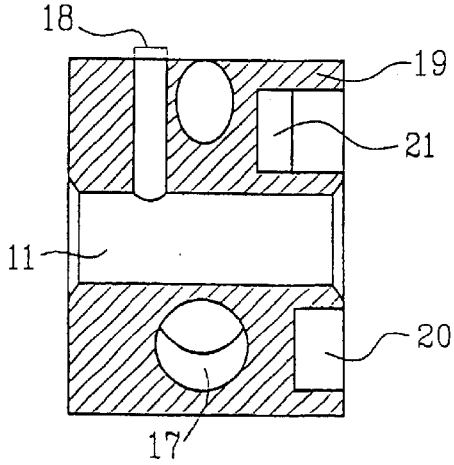
FIG. 9 shows a vertical cross-sectional view through the sight unit and through its rotation axis.
Figure 10:
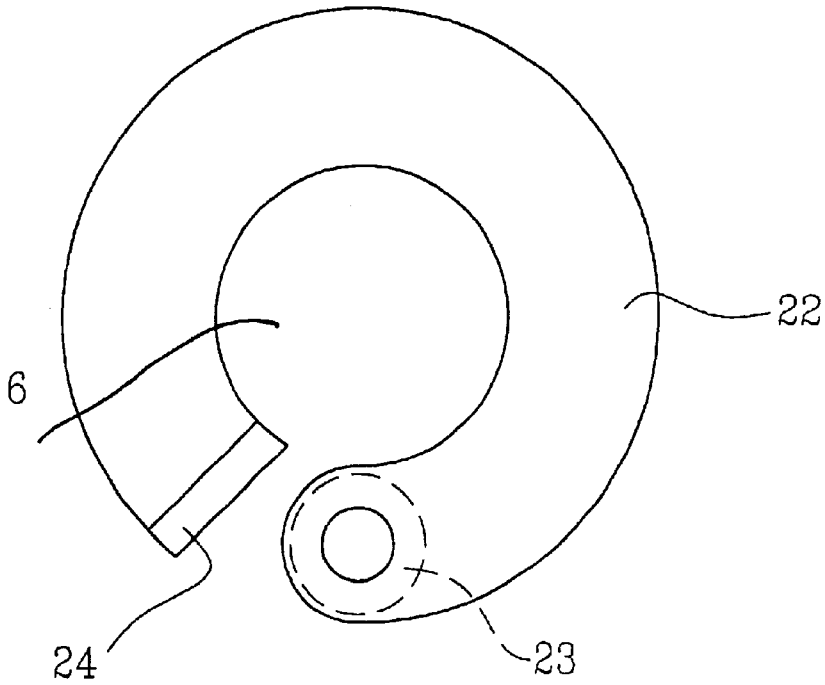
FIG. 10 shows a side view of a spring for side holding of the sight unit.
Figure 11:
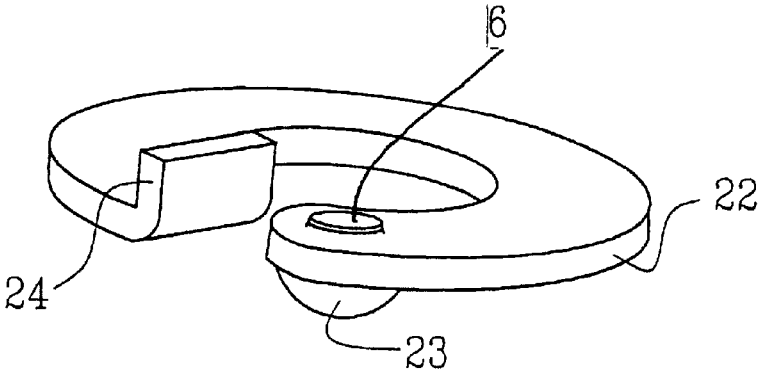
FIG. 11 shows a view of the spring according to FIG. 10 seen from above.

A sight 10 is substantially cylindrically designed having a centrally arranged, through-going hole 11 and comprises three recesses 12, 13, and 14 arranged evenly distributed in the cylindrical envelope surface, between which recesses three different diopters 15, 16, and 17 are arranged in the cylindrical body 10. The centre of two of the diopters 15, and 16 are arranged at different heights, but have preferably the same aperture diameter. The centres of the diopters 15 and 16 can, however, be displaced sideways in relation to each other to eliminate a less side deviation of a shot at shorter range compared to a longer range. The third diopter 17 is, in this embodiment, an enlarged diopter adapted for darkness and close range firing, but can also be a diopter for a third distance. In the cylindrical envelope surface a pin 18 is arranged as evident from FIG. 7, which pin is intended to prevent the rotation of the sight unit 10 in the sight house 1, but only allow for a turning to and fro between the different diopter positions, which will be explained more in detail below. The drum of the sight 10 is knurled on its outer side, partly to provide for an improved grip at rotation, partly to reduce reflexions. One end wall 19 of the sight unit is provided with an annular track 20 provided with a recess 21.

The centrally arranged through-going hole 11 of the sight unit 10 is threaded.

An annularly designed spring 22 is arranged to be applied in the annular track 21. The spring 22 which is substantially annularly circular, however, not closed, has in its one end a semi-spherical projection 23 and in its other end a counter stop 24 arranged to be introduced into the previously mentioned recess 21 arranged in the side wall 19 of the sight unit 10.

A bolt 25 going through the sight unit 10 and the side walls of the sight house 1 is provided with a bolt head 26 provided with a pin 27 arranged on the side facing the bolt, which pin is arranged to fit into the totally six borings 9 made in the side wall 4 of the sight house and the through-going holes 8 which six recesses are displaced 60° in relation to each other. The bolt is further threaded over its pin part having a threading adapted to the through-going hole 11 of the sight unit.

The sight unit 10 is arranged into the sight house 1 by means of the bolt 25, whereby the spring 22 has been previously introduced into track 20. When adjusting the elevation the cylindrical house is turned around its axis 25 between the pins (not shown) to obtain the limiting points whereby the desired diopter is introduced into the sight line.

For adjustment of the point of impact sideways the bolt 25 is first released at the hole 6 by pushing the bolt 25 against the spring force created by the spring 22 in order to bring the pin 27 out off its position, whereafter the bolt 25 is turned between the different recesses 8, 9, whereby the sight unit 10 simultaneously moves along the pin of the bolt 27 by means of the thread. When the sideways movement is enough one checks that the pin 27 fits into said recesses 8, 9 for locking the same. The sideways movement is suitably made each time from a fixed position as e.g., using the pin (not shown) abutting the rear wall 5 of the sight house.

The spring 22 serves to lock the different diopter positions as the semi-spherical projection 23 of the spring 22 fits into the through-going holes 8 evenly distributed in the side wall 4. Hereby one feels as well, when one has reached a correct position of the diopter as the projection snaps into said hole 8.

The thread of the sight screw is suitably adapted to the distribution of six holes in outer side of the side wall 4, so that the sighting line is evenly moved. The even distribution leads to, e.g., a movement of the hit point of 5 cm at a shooting range of 100 m and one "snap" of adjustment.

By means of the present invention it is thus achieved that a front sight of a weapon can be made fixed sideways and that shooting adjustment in vertical position is only needed by vertical movement of the front sight along its vertical axis.

The present invention is not restricted to the embodiment shown herein but can be varied within the scope of the accompanying claims. Such modifications and variations are evident to the one skilled in the art.

What is claimed is:

1. A sight for firearms, which sight comprises a sight house being applicable onto the upper side of a weapon and having a cylindrical sight unit present in the sight house and an axis of said cylindrical sight unit arranged perpendicular to the longitudinal axis of a sight line of said sight unit through said sight, which said sight unit comprises segmented extending diopter apertures and being rotatably arranged and substantially horizontally positionable on a threaded bolt which runs between walls of said sight house, the sight unit having on its one side wall a spring arranged to said wall for sideways locking of the sight unit into said sight house.

2. A sight according to claim 1, wherein the threaded bolt has a pin on its bolt head, said pin is arranged to be introduced into a side wall of the sight house.

3. A sight according to claim 1, wherein the spring in its other end has a counter stop arranged to lock the spring against said wall to prevent rotation of said spring.

4. A sight according to claim 1, wherein the center lines of the diopter apertures of the sight unit are arranged at different distances from the center axis of the sight unit.

5. A sight according to claim 1, wherein one diopter aperture of the sight unit is intended for darkness and close range combat shooting.

6. A sight for firearms, which sight comprises a sight house being applicable onto the upper side of a weapon and having a cylindrical sight unit present in the sight house and an axis of said cylindrical sight unit arranged perpendicular to the longitudinal axis of a sight line of said sight unit through said sight, which said sight unit comprises segmented extending diopter apertures and being rotatably arranged and substantially horizontally positionable on a threaded bolt which runs between walls of said sight house, the sight unit having on its one side wall a spring arranged to said wall for sideways locking of the sight unit into said sight house and whereby the spring in its other end has a counter stop arranged to lock the spring against said side wall to prevent rotation of said spring, and whereby the bolt being provided with a locking pin is releasably arranged by a sidewise movement of the bolt against the spring force created by the spring in order to bring the pin out off its locking position, and rotating the bolt to move said sight unit along the bolt.

7. A sight according to claim 6, wherein the center lines of the diopter apertures of the sight unit are arranged at different distances from the center axis of the sight unit.

8. A sight according to claim 6, wherein one diopter aperture of the sight unit is intended for darkness and close range combat shooting.

* * * * *